United States Patent [19]

Maroszek

[11] 4,199,059

[45] Apr. 22, 1980

[54] WRISTWATCH DISPLAY CARTON

[75] Inventor: Raymond V. Maroszek, Neenah, Wis.

[73] Assignee: American Can Company, Greenwich, Conn.

[21] Appl. No.: 914,891

[22] Filed: Jun. 12, 1978

[51] Int. Cl.[2] ..... B65D 5/50

[52] U.S. Cl. ..... 206/45.18; 206/45.19; 206/487; 206/566; 229/16 D

[58] Field of Search ..... 206/45.19, 45.18, 45.14, 206/486, 487, 566; 229/16 D

[56] References Cited

U.S. PATENT DOCUMENTS

| | | | |
|---|---|---|---|
| 720,345 | 2/1903 | Hazeltine | 229/16 D |
| 1,263,819 | 4/1918 | Thorndike | 229/16 D |
| 1,380,561 | 6/1921 | Kaufmann | 229/16 D |
| 1,501,016 | 7/1924 | Young | 206/45.19 |
| 1,764,216 | 6/1930 | Laubenheimer | 206/45.19 |
| 4,011,942 | 3/1977 | Crosslen | 206/566 |
| 4,128,167 | 12/1978 | Hogshead | 206/45.19 |

*Primary Examiner*—Joseph M. Moy
*Attorney, Agent, or Firm*—Robert P. Auber; Ira S. Dorman; George P. Ziehmer

[57] ABSTRACT

A wristwatch display carton is disclosed which includes a face panel, having a cut-out therein to receive the wristwatch, which is positioned at an inclined angle tilting into the interior of the carton so that wristwatch is partially sheltered by the top and sides of the carton. A pair of infolding flaps attached respectively to the opposed side panels aid in positioning the face panel within the carton. Four different embodiments of blanks from which the carton may be erected are disclosed.

12 Claims, 12 Drawing Figures

WRISTWATCH DISPLAY CARTON

BACKGROUND OF THE INVENTION

1. Field of the Invention

The present invention relates to paperboard cartons in general, and, in particular, to display cartons for carrying objects to be sold in which the object may also be displayed in a retail situation.

2. Description of the Prior Art

The prior art is generally cognizant of the use of tilted panels, which are inclined into the interior of a carton, for use in paperboard cartons. Such panels have been used in cartons needing spout openings in which the inclined panel is connected to the sides of the carton by infolding panels and is designed to be folded into and out of the carton depending upon whether or not the spout is needed for use. Such designs are not readily applicable to cartons for use as a display container for retail items such as wristwatches, however.

The prior art also contains examples of paperboard containers used for receiving wristwatches or other similar items. It has been a problem with such containers in that the wristwatch is not carried in the container in such a way that it may be displayed in a retail situation or that if such a display is possible, the wristwatch, when displayed, is in no way sheltered by the container so as to avoid contact from other objects.

SUMMARY OF THE INVENTION

The present invention is summarized in that a wristwatch display carton includes a pair of vertical side panels each having the general shape of a rectangle having its front upper corner truncated by a canted edge, each side panel thus having front and back vertical edges, top and bottom horizontal edges, and a canted edge; a bottom panel extending between the bottom horizontal edges of the two side panels; a back panel extending between the back vertical edges of the two side edges; a top panel extending between the top horizontal edges of the two side panels; a front panel extending between the front and vertical edges of the two side panels; and, a face panel attached to the front panel and extending upward between the side panels, the face panel having a watch-receiving cut-out formed therein, the face panel being oriented at an inclined angle back between the side panels so that a watch in a recess is partially sheltered by the top panel and the canted edges of the side panels.

It is an object of the present invention to provide a paperboard carton for carrying a wristwatch which may be used for both shipping and display of the wristwatch without altering the carton.

It is another object of the present invention to provide such a carton for carrying and displaying a wristwatch in which the wristwatch is partially sheltered from contact with other objects when displayed within the carton.

It is yet another object of the present invention to provide a blank from which such a carton may be erected.

Other objects, advantages, and features of the present invention will become apparent from the following specification when taken in conjunction with the accompanying drawings.

DESCRIPTION OF THE PREFERRED EMBODIMENTS

Figure 1:
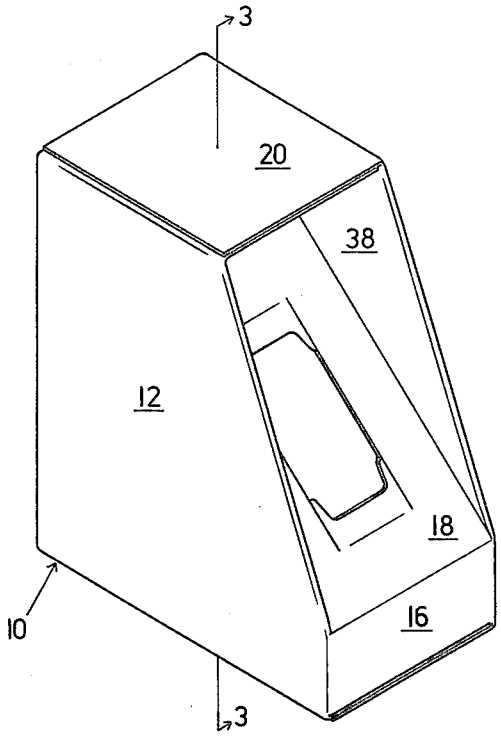
FIG. 1 is a perspective view of a wristwatch display carton constructed according to the present invention.

Shown in FIG. 1 is a wristwatch display carton, generally indicated at 10, constructed in accordance with the present invention. The carton 10 includes a pair of parallel vertically oriented side panels 12 and 14 which are joined at their vertical front edges by a rectangular front panel 16. Extending upward and tilted inward from the front panel 16 between the side panels 12 and 14 is an inset rectangular face panel 18 which is oriented at an inclined angle inward between the side panels 12 and 14 toward the top of the carton 10. The top of the carton 10 is formed by a top panel 20 folded from the side panel 14.

Figure 2:
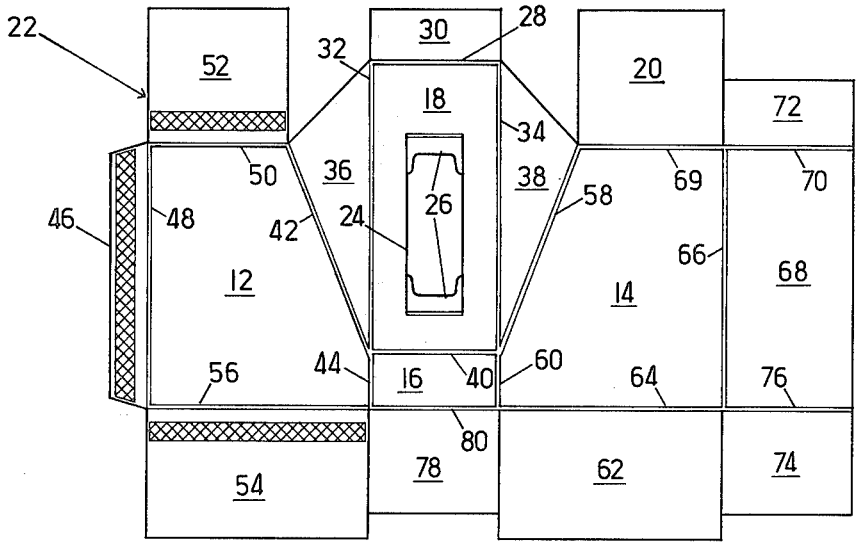
FIG. 2 is a plan view of a paperboard blank from which the carton of FIG. 1 is erected.

Shown in FIG. 2 is a paperboard blank, generally indicated at 22, from which the carton 10 of FIG. 1 is fabricated. The blank 22 is shown as viewed from the side thereof that is to be the outside of the carton 10. the blank 22 has centrally formed therein the face panel 18 which is an elongated rectangular panel. Centrally formed in the face panel 18 is a rectangular, elongated watch-receiving cut-out 24 which is positioned centrally in the face panel 18. A pair of watch band tabs 26 are formed at the opposite ends of the cut-out 24 and are attached to the face panel 18 by respective score lines. At one short end of the face panel 18 a score line 28 attaches the face panel 18 to a face panel positioning flap 30. Along the sides of the face panel 18, the face panel 18 is connected by respective score lines 32 and 34 to a pair of triangularly shaped infolding flaps 36 and 38. At its other shorter end the face panel 18 is attached to the front panel 16 by a score line 40.

The side panel 12 is a five sides panel formed in a generally rectangular shape having one corner truncated by a canted edge, the canted edge being formed by a canted score line 42 which connects the side panel 12 to the folding panel 36. Along its front edge the side panel 12 is attached to the front panel 16 by a score line 44. Along its rear edge, the side panel 12 is attached to a back glue flap 46 by a score line 48. Along its top edge the side panel 12 is connected by a score line 50 to a top glue flap 52 and along its bottom edge the side panel 12 is attached to a bottom glue flap 54 by a score line 56. The side panel 14 is also a five sided panel corresponding in shape to the side panel 12. Along its canted edge, the side panel 14 is attached to the infolding panel 38 by a canted score line 58, and the side panel 14 is further attached along its front edge to the front panel 16 by a score line 60. At its bottom edge the side panel 14 is connected to a bottom flap 62 by a score line 64. Along its back edge, the side panel 14 is defined by a generally rectangular shape. Along the top edge of the side panel 14, a score line 69 is formed to attach the top panel 20 thereto. One short side of the back panel 68 is formed by a score line 70 which attaches the back panel 68 to an interior top flap 72 and at its other short edge the back panel 68 is attached to an interior bottom flap 74 by a score line 76. Another interior bottom flap 78 is attached to the bottom of the front panel 16 by a score line 80.

Figure 3:
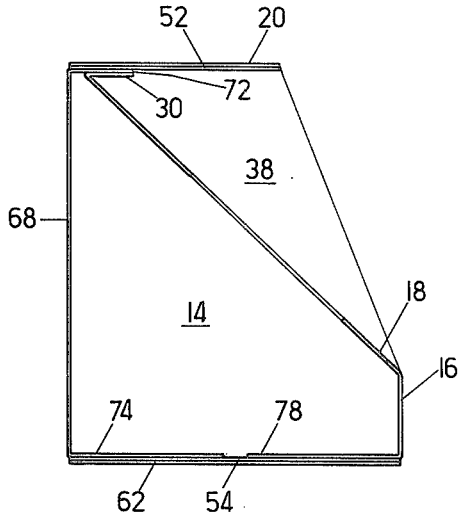
FIG. 3 is a cross-sectional view taken along the lines 3—3 in FIG. 1.

In constructing the carton 10 from the blank 22, glue is first applied to the blank 22 in the areas indicated by the crosshatched lines in FIG. 2. The infolding flaps 36 and 38 are then folded toward the side panels 12 and 14 respectively as the side panels 12 and 14 are folded to be perpendicular to the front panel 16. This folding tilts the face panel 18 inwardly so that it is positioned between the side panels 12 and 14. The back glue flap 46 can then be folded along the score line 48 to be perpendicular to the side panel 12 and the back panel 68 can be folded along the score line 66 to be perpendicular to the side panel 14 to thereby overlie the back glue flap 46 to adhere thereto. To finish the top of the carton 10, the positioning flap 30 is folded toward the front of the carton along the score line 28, and then the interior top flap 72 is folded inwardly along the score line 70 over the positioning flap 30 to the position as shown in the cross sectional view of FIG. 3. Then the top glue flap 52 is folded over along the score line 50 to be perpendicular to the side panel 12 and the top panel 20 is folded over on top of the top glue flap 52 along the score lines 69 to be securely adhered thereto to fix the top of the carton 10. To secure the bottom of the carton 10, the two interior bottom flaps 74 and 78 are first folded inwardly along respective score lines 76 and 80 to be perpendicular respectively to the back panel 68 and the front panel 16. The bottom glue flap 54 can then be infolded along the score line 56 and the bottom flap 62 infolded along the score line 64 on top of the bottom glue flap 54 to adhere thereto to secure the bottom of the carbon 10.

As can be seen in FIG. 1, the folding of the infolding flaps 36 and 38 helps to position the face panel 18 in a position canted inwardly inbetween the two side panels 12 and 14. A wristwatch may be positioned in the wristwatch cut-out 24 with the face of the dial being oriented in a display position by the face panel 18. The watchband tabs 26 serve to grasp the side of the wristwatch band and to allow the positioning of different sizes, such as ladies' and men's, of wristwatches within the cut-out 24 in the face panel 18. When a wristwatch is so received in the carton 10 on the face panel 18, the front of the wristwatch is partially sheltered by the overhang of the top panel 20 and the side panels 12 and 14 so that the carton 10 may be wrapped or covered by another box or other wrapping without this exterior wrapping contacting the wristwatch received within the carton 10. The wristwatch within the carton 10 is always positioned in an orientation which is suitable for display upon the first unwrapping of the exterior wrapping around the carton 10. This partial sheltering of the wristwatch by the overhang of the top panel 20 and the canted edges of the side panels 12 and 14 is particularly advantageous in a retail environment since the wristwatch is then at least partially sheltered from potentially damaging contact with other objects and yet is still prominently and visibly displayed.

Figure 4:
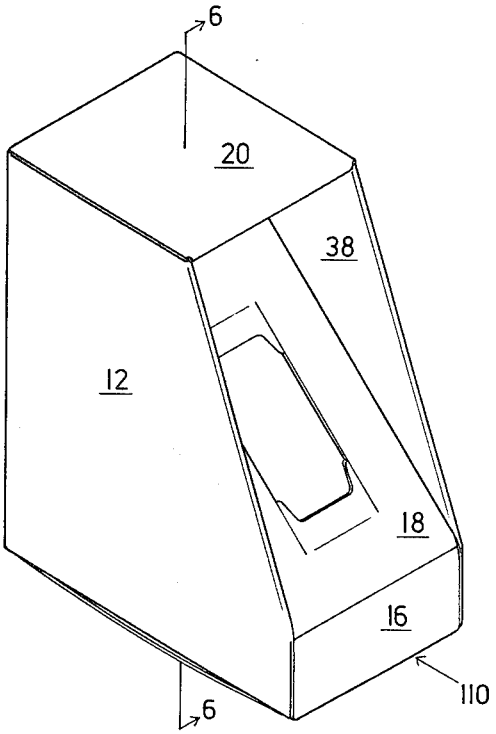
FIG. 4 is a perspective view of an alternative embodiment of a wristwatch display carton constructed according to the present invention.

Shown in FIG. 4 is an alternative embodiment of the wristwatch display carton, generally indicated at 110, also constructed in accordance with the present invention. Parts of the wristwatch display carton 110 which are identical to the corresponding parts of the wristwatch display carton 10 have been given identical reference numerals and will not be discussed herein in further detail. Parts of the wristwatch display carton 110 which differ from parts of the carton 10 are described herein and are given reference numerals beginning with 100. The carton 110 is similar in appearance to the carbon 10 having the side panels 12 and 14 joined by their front edges by the front panel 18 from which the tilted force panel 18 is inclined into the interior of the carton 10 between the side panels 12 and 14. A top panel 20 covers the top of the carton 110.

Figure 5:
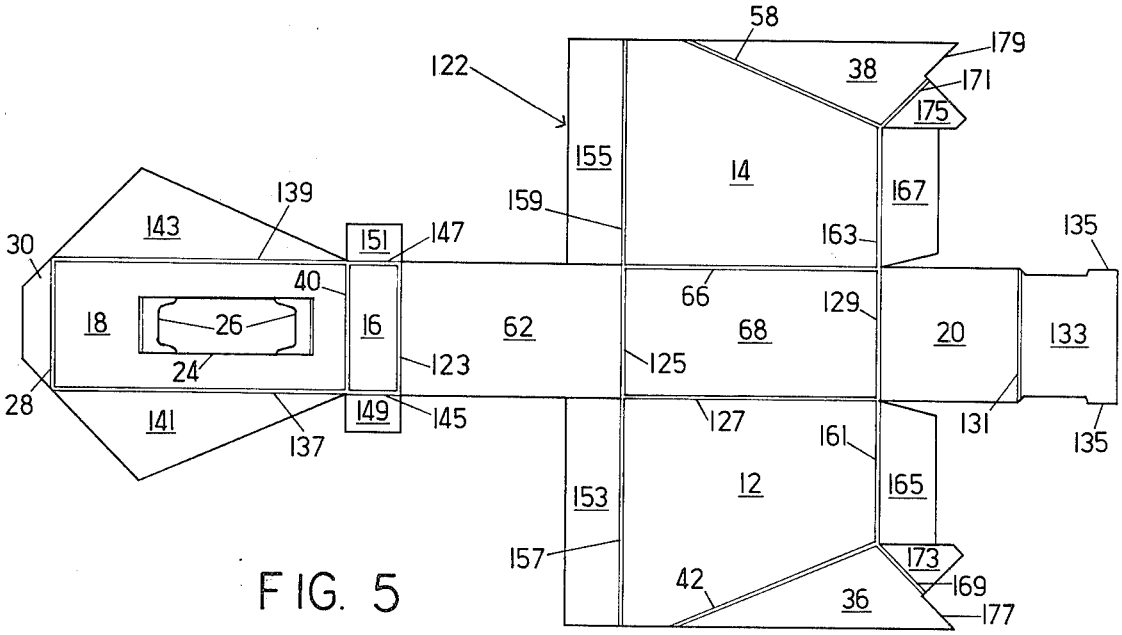
FIG. 5 is plan view of a paperboard blank from which the carton of FIG. 4 is erected.

The carton 110 of FIG. 4 is constructed from a paperboard blank, generally indicated at 122, and shown in FIG. 5. The blank 122 is shown in FIG. 5 as viewed from the side that is to be the interior of the finished carton 110. In the blank 122, as in the blank 22 of FIG. 2, the positioning flap 30 is connected by the score line 28 to the face panel 18 which is connected at its other end by the score line 40 to the front panel 16. In the blank 122, the front panel 16 is connected by a score line 123 along its opposite edge to one end of the bottom flap 62 which is attached along its other end by a score line 125 to a short side of the rectangular back panel 68. The back panel 68 is connected by the score line 66 along one of its long sides to the side panel 14 and is connected along the other of its long sides by a score line 127 to the side panel 12. Along its short end opposite from the score line 125, the back panel 68 is attached to the top panel 20 by a score line 129. Attached to the top panel 20 by a score line 131 is a lock flap 133. The lock flap 133 is slightly narrower than the top panel 20 along most of its length but at its extreme end has a pair of outwardly extending lock tabs 135 formed on it. Along the sides of the face panel 18 a pair of score lines 137 and 139 attach the face panel 18 to a pair of triangular flaps 141 and 143. The triangular flaps 141 and 143 are, of course, triangularly shaped and generally corresponding in size and shape to the infolding flaps 36 and 38. Attached to the sides of the front panel 16 by respective score lines 145 and 147 are a pair of small rectangular front side flaps 149 and 151. Formed extending along the long bottom edges of the side panels 12 and 14 are a pair of interior bottom flaps 153 and 155 attached to the side panels 12 and 14 respectively by score lines 157 and 159. Along the shorter top edges of the respective side panels 12 and 14 score lines 161 and 163 are provided to attach infolding top flaps 165 and 167 respectively to the side panels 12 and 14. Each of the infolding flaps 36 and 38 has a portion of its upper edge formed by a respective one of score lines 169 and 171 which attach respective positioning wings 173 and 175 to the infolding flaps 36 and 38. A pair of notches 177 and 179 are formed along the remainder of the top edges of the infolding flaps 36 and 38.

Figure 6:
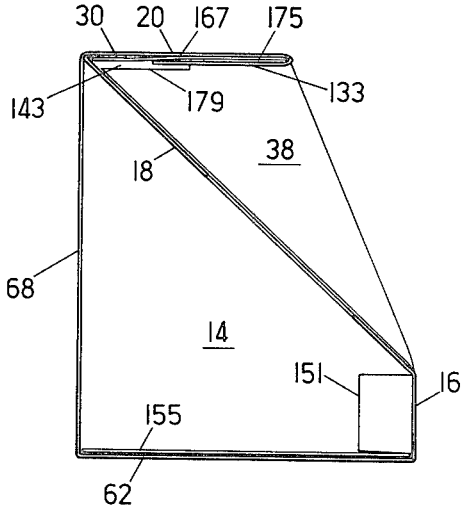
FIG. 6 is a cross-sectional view taken along the lines 6—6 in FIG. 4.

In folding the display carton 110 from the blank 122 the side panels 12 and 14 are first folded along the score lines 127 and 66 to be perpendicular to the back panel 68. Then the interior bottom flaps 153 and 155 are folded along respective score lines 157 and 159 to also be perpendicular to the respective side panels 12 and 14 and to extend into and across the bottom of the carton 110. Then the bottom panel 62 is folded upward along the score line 125 to also be perpendicular to the back panel 68 and to overlie the interior bottom flaps 153 and 155. The front side flaps 149 and 151 may then be folded upward along the score lines 145 and 147 to extend vertically upward and be perpendicular to the front panel 16. At the same time, the triangular flaps 141 and 143 are folded downward along the score lines 137 and 139 to extend vertically downward and be perpendicular to the face panel 18. Then the front panel 16 may be folded upward along the score line 123 with the front side flaps 149 and 151 being inserted inside the side flaps 12 and 14 and above the interior bottom flaps 153 and 155, with the final position of the front side flap 151 being shown in FIG. 6. The face panel 18 may then be tilted downward inside the interior of the carton between the side panels 12 and 14 with the triangular flaps 141 and 143 being received extending vertically upward therefrom lying against the interior of the respective side panels 12 and 14. The positioning flap 30 is received against the interior of the top panel 20. The infolding flaps 36 and 38 may then be infolded along the score lines 42 and 58 respectively against the interior of the side panels 12 and 14 such that the triangular flaps 141 and 143 are pinned respectively between the infolding flap 36 and the side panel 12 and the in folding flap 38 and the side panel 14. Then the infolding top flaps 165 and 167 may be folded inwardly along the score lines 161 and 163 to be perpendicular to the side panels 12 and 14 to overlie the top of the carton 110. This folding also folds inwardly the positioning wings 173 and 175 along the score lines 169 and 171. The relative positioning of the infolding top flaps 167 and the positioning wing 175 in the erected configuration of the carton 110 may be seen in FIG. 6. Then the top panel 20 is folded downward along the score line 129 until the top panel 20 is in a generally horizontal position overlying the top of the carton 110. This folding of the top panel 20 also folds the positioning panel 30 over the top of the rearward edges of the infolding top flaps 165 and 167. The lock flap 133 may then be folded downward and inwardly along the score line 131 into the interior of the carton 110 until the lock tabs 135 are received in the notches 177 and 179 formed in the top of the infolding flaps 36 and 38. The locked tabs 135 lock into the respective notches 177 and 179 to lock the carton in its erected position without the need for any glue.

Thus, a wristwatch display carton 110 similar to the wristwatch display carton 10 of FIG. 1, is formed such that in its erected position it requires no glue to retain its erected state. The face panel 18 is retained in position by the action of the locking of the top of the carton which pins the positioning panel 30 between the infolding top flaps 165 and 167 and the top panel 20. The infolding flaps 36 and 38 themselves are retained in position by the positioning of the lock flap 133 between the tops of the infolding flaps. The infolding flaps 36 and 38 also serve to help fit the face panel 18 in position by providing the locking notches 177 and 179 for locking the top of the carton and by holding in place the triangular flaps 141 and 143. The bottom of the carton 110 is secured by the front side flaps 149 and 151 being received above the interior bottom flaps 153 and 155. The carton 110 is thus similar in its appearance and function to the carton 10 of FIG. 1, and yet requires no gluing or fasteners to retain its erected status.

Figure 7:
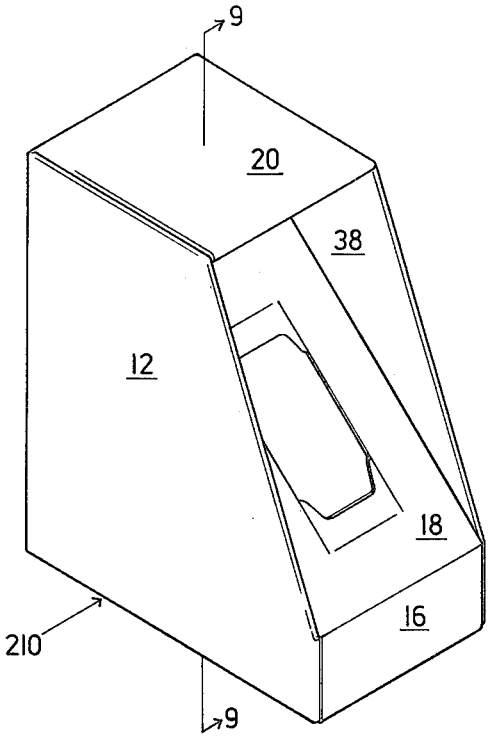
FIG. 7 is a perspective view of another alternative embodiment of a wristwatch display carton constructed in accordance with the present invention.

Shown in FIG. 7 is another alternative embodiment of a wristwatch display carton constructed according to the present invention, generally indicated at 210. Parts of the wristwatch display carton 210 which are identical to parts of the cartons 110 and 10 are indicated by identical reference numerals and will not be further described herein, and parts of the carton 210 which are new or different from corresponding parts of the cartons 10 or 110 are indicated by reference numerals beginning with 200. The carton 210 generally resembles the cartons 110 and 10, with the two side panels 12 and 14 being joined at their lower front edges by a front panel 16. The face panel 18 extends upward from the front panel 16 inbetween the side panels 12 and 14 and the top of the carton is formed by a top panel 20.

Figure 8:
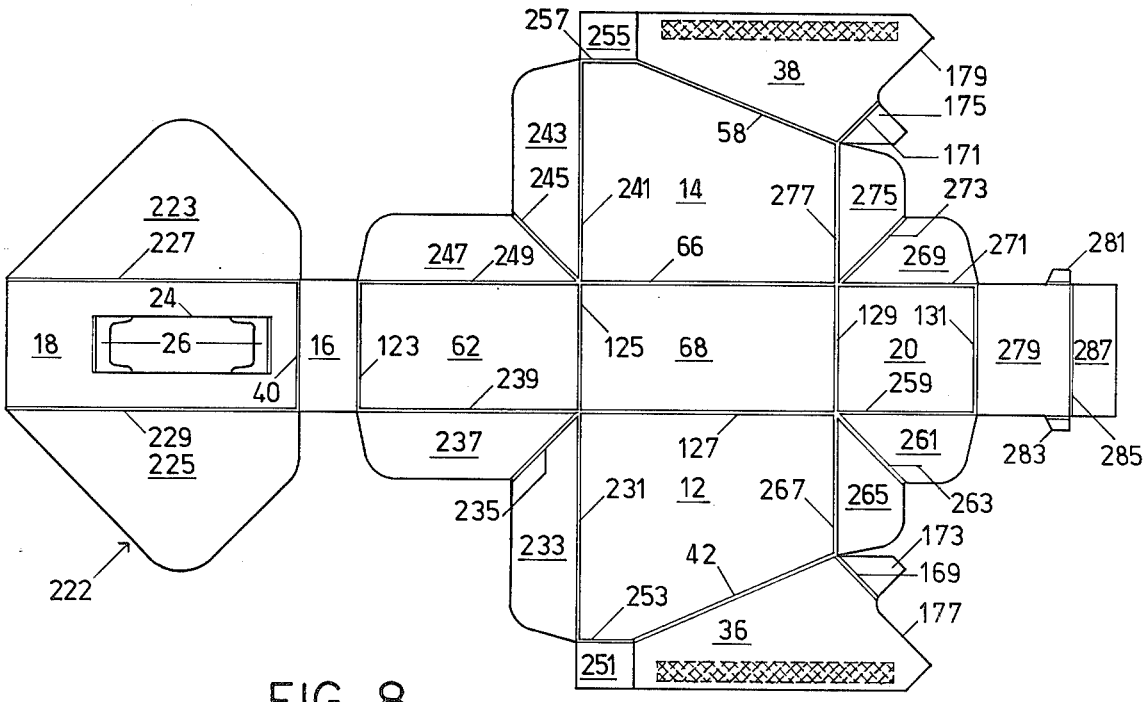
FIG. 8 is a plan view of a blank from which the carton of FIG. 7 is constructed.

Shown in FIG. 8 is a paperboard blank, generally indicated at 222, from which the carton 210 of FIG. 7 is constructed. The blank 222 is also shown as viewed from its exterior side. In the carton blank 222 the face panel 18 has its side edges formed by respective score lines 227 and 229 to attach to the sides of the face panel 18 a pair of retaining flaps 223 and 225 which are generally rounded but taper away from the face panel 18. Each of the retaining flaps 223 and 225 has a short flattened side parallel to and adjacent to the score line 40 connecting the face panel 18 and the front panel 16. A pair of lower tuck flaps 233 and 237 are formed extending between the bottom panel 62 and the side panel 12 with the tuck flap 233 being attached to the side panel 12 by the score line 231 and the tuck flap 237 being attached to the bottom panel 62 by a score line 249, the tuck flaps 233 and 237 being joined together by a score line 235. Similar lower tuck flaps 243 and 247 are formed extending between the side panel 14 and the bottom panel 62 with the tuck flaps 243 and 247 being joined by a score line 245 and the tuck flaps 243 and 247 being connected to the side panel 14 and the bottom panel 62 respectively by score lines 241 and 249. Attached to the front edges of the side panels 12 and 14 by score lines 253 and 257 are small rectangular retaining tabs 251 and 255. The infolding flaps 36 and 38 are formed to be somewhat larger than the flaps in the blanks 22 and 122 as are the notches 177 and 179. Along the side of the top panel 20 is formed a score line 259 which attaches to the top panel 20 an upper tuck flap 261 which has a score line 263 at its other edge to attach it to another upper tuck flap 265 which is attached in turn by a score line 267 to the top edge of the side panel 12. Along the other side of the top panel 20 is formed a score line 271 securing thereto another upper tuck flap 269 which has at its other edge a score line 273 attaching to it a complementary upper tuck flap 275 which in turn has at its other edge a score line 277 which forms the top edge of the side panel 14. A lock flap 279 is attached by the score line 131 to the top panel 20 and has a pair of locking tabs 281 and 283 formed extending outwardly therefrom. A cover flap 287 is attached by a score line 285 to the lock flap 279.

In erecting the display carton 210 from the blank 222, the blank 222 first has adhesive applied to its interior surface, which is the side away from the viewer in FIG.

Figure 9:
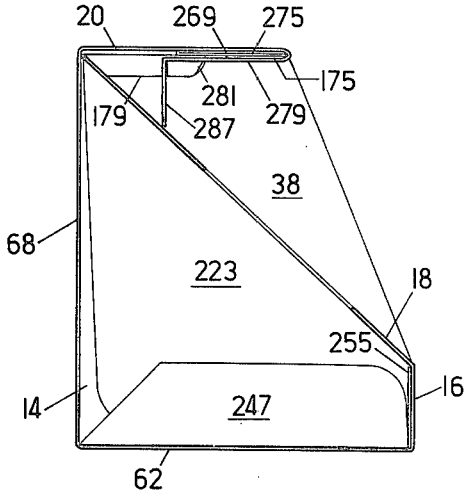
FIG. 9 is a cross-sectional view taken along the lines 9—9 in FIG. 7.

8, in the areas indicated by the broken crosshatching in FIG. 8. The first step in the erection of the blank sheet 22 is that the infolding flaps 36 and 38 are folded inwardly along the score lines 42 and 58 againsts the interior of the side panels 12 and 14 so that the infolding panels 36 and 38 adhere thereto. The side panels 12 and 14 may then be folded along the respective score lines 127 and 66 to be perpendicular to the back panel 68. This folding also folds the tuck panels 237, 247, 261, and 269 along the score lines 239, 249, 259, and 271 respectively. The bottom panel 62 is then upfolded along the score line 125 while at the same time the score lines 235 and 245 are inserted into and between the side panels 12 and 14 so that the respective pairs of tuck panels 233 and 237 and 243 and 247 are folded against each other and into and between the side panels 12 and 14. The pairs of folded together tuck panels 233 and 237 and 243 and 247 are folded against the interior of the respective side panels 12 and 14. The retaining tabs 251 and 255 are then folded inwardly along the score lines 253 and 257 to be parallel to the respective side panels 12 and 14. The retaining flaps 223 and 225 are then folded upwardly along the score lines 227 and 229 to be perpendicular to the face panel 18, and the face panel 18 and the front panel 16 are then folded upward as a unit along the score line 123 with the retaining flaps 223 and 225 being inserted inside of the side panels 12 and 14. The face panel 18 is then folded along the score line 40 relative to the front panel 16 inwardly inbetween the side panels 12 and 14, with the retaining flaps 223 and 225 being inserted between the respective side panels 12 and 14 and the pairs of infolded tuck flaps 233 and 237 and 243 and 247, as is shown with respect to the retaining flap 223 in FIG. 9. This action also folds the short flattened side of the retaining flaps 223 and 225 over the respective retaining tabs 255 and 251 as is shown also with respect to the retaining flap 223 in FIG. 9. The top panel 20 may then be folded along the score line 129 with the respective pairs of upper tuck flaps 261 and 265 and 269 and 275 being folded together and being held against the interior of the top panel 20. The lock flap 279 is then folded inwardly along the score line 131 into the area between the side panels 12 and 14 with the locking tabs 281 and 283 being bent by that folding as they pass between the side panels 12 and 14. At the same time the depending cover flap 287 is bent downward along the score line 285 such that when the lock flap 279 is locked into its horizontal position, as shown in FIG. 9, the cover flap 287 is received in a generally horizontal position covering the lock on the interior of the top of the carton, as is also shown in FIG. 9. The cover flap 287 is locked in position by the locking tabs 281 and 283 which are received in the notches 179 and 177 of the infolding flaps 36 and 38, as can be seen with respect to the locking tab 281 in FIG. 9.

The blank 222 may thus be erected into a carton 210 which is similar in appearance and function to the carton 10 of FIG. 1 and the carton 110 of FIG. 4. The blank 222 only requires a very small amount of glue to complete its erection, and the carton 210 is largely maintained in its erected state by the interlocking of the retaining flaps 223 and 225 with the retaining tabs 251 and 255 and the locking of the lock flap 279 with its lock tabs 281 and 283 into the notches 171 and 179.

Figure 10:
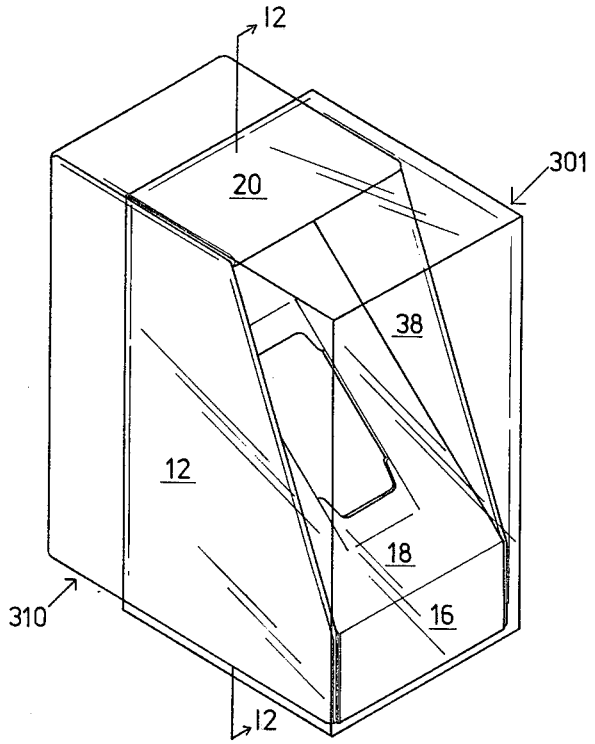
FIG. 10 is a perspective view of yet another alternative embodiment of a wristwatch display carton constructed in accordance with the present invention.

Shown in FIG. 10 is yet another alternative embodiment of a wristwatch display carton constructed according to the present invention, generally indicated at 310. Parts of the wristwatch display carton 310 which are identical to parts of the cartons 210, 110 and 10 are indicated by identical reference numerals and will not be discussed further herein, and parts of the carton 310 which are new or different from corresponding parts of those cartons so indicated by reference numerals beginning with 300. The carton 310 generally resembles the cartons 210, 110 and 10 with the side panels 12 and 14 being joined at their front edges by the front panel 16 from which the face panel 18 extends inwardly between the side panels 12 and 14. The top panel 20 closes the top of the carton 310. A transparent plastic cover 301 open at one end is received over the front of the carton 310.

Figure 11:
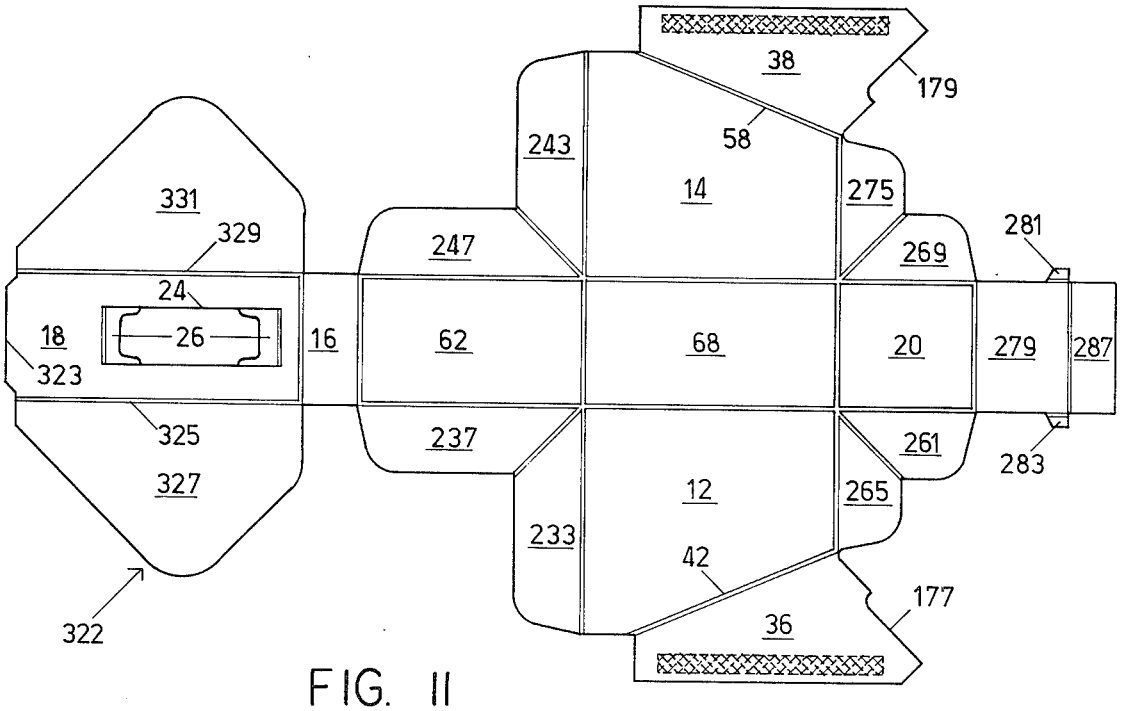
FIG. 11 is a plan view of a blank from which the carton of FIG. 10 is erected.

Shown in FIG. 11 is a paperboard blank, generally indicated at 322, from which the carton 310 is constructed. The blank 322 is largely similar to the blank 222 and only the differences therebetween will be discussed herein. The face panel 18 of the blank 322 has formed at its uppermost edge a tab edge 323 which is extended somewhat in its middle portion and tapered at its edges. A somewhat larger retaining flap 327, attached to the face panel 18 by a score line 325, is formed in the blank 322. Similarly a somewhat larger retaining flap 331 is formed attached to the other side of the face panel 18 by a score line 329. The blank 322 has no retaining tabs corresponding to those in the blank 222.

Figure 12:
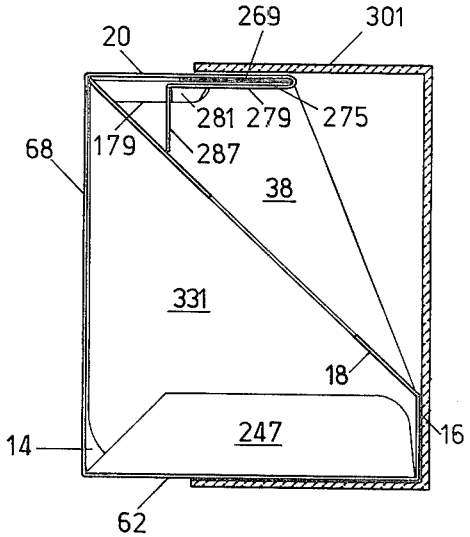
FIG. 12 is a cross-sectional view taken along the lines 12—12 in FIG. 10.

In erecting the carton 310 from the blank 322, the same procedure is followed as without lines for the blank 222 except for the minor difference discussed herein below. Since the retaining flaps 327 and 331 are somewhat larger than the corresponding parts of the blank 222, when they are inserted inbetween the side panels 12 and 14, the face panel 18 is folded until those panels abut the bottom panel 16 and the back panel 68 as is shown in FIG. 12. Thus, the retaining flaps 327 and 331 aid in the positioning of the face panel 18. The tab edge 323 of the face panel 18 is received in the uppermost back corner of the carton 310 with the tapered corners of that edge engaging the folded pairs of tuck flaps 261 and 265 and 269 and 275. When the carton 310 is erected, the cover 301 may be inserted over the front of the carton 310 as is shown in FIG. 12.

The carton 310 is similar in function and appearance to the carton 210 with the exception of the provision for the cover 301. The cover 301 serves to protect the watch within the carton 310 while allowing it to be viewed by a potential purchaser. The cover 301 is, of course, equally usable with each of the other embodiments of the carton 210, 110 or 10. It is also envisioned that the cover 301 may be made of paperboard or other non-transparent material as well as transparent materials.

It is understood that the present invention is not limited to the particular construction and arrangement of parts disclosed and illustrated herein, but embraces all modified forms thereof as come within the scope of the following claims.

I claim:

1. A wristwatch display carton comprising:

a. a pair of parallel vertical side panels each having the general shape of a rectangle having its front upper corner truncated by a canted edge, each side panel having front and back edges, top and bottom edges and the canted edge;

b. a bottom panel extending between the bottom edges of the two side panels;

c. a back panel extending between the back edges of the two side panels;

d. a top panel extending between the top edges of the two side panels;

e. a front panel extending between the front edges of the two side panels;

f. a face panel attached to the front panel and extending upward between the side panels, the face panel having a watch-receiving cut-out formed therein, the face panel being oriented at an inclined angle back between the side panels so that a watch received in the cut-out is partially sheltered by the top panel and the canted edges of the side panels;

g. a respective infolding panel attached to the canted edge of each of the side panels and folded over to lie adjacent the respective side panel to aid in fixing the face panel in position, each of the infolding panels having a notch formed in its upper edge; and h. a lock flap attached to the top panel and having locking tabs thereon, the lock flap being folded inward with the locking tabs being received in the notches in the infolding panels to fix the top of the carton in place.

2. A blank for a wristwatch display carton comprising:

a. a rectangular face panel having a watch-receiving cut-out formed therein;

b. a front panel attached to one edge of the face panel;

c. a pair of side panels formed in the blank so as to be foldable to be disposed on opposite sides of the face panel, each side panel having the general shape of a rectangle having one corner truncated by a canted scoreline;

d. a respective infolding panel attached to each of the side panels by the canted scoreline, the infolding panels each being foldable over to lie adjacent the respective side panel to aid in fixing the face panel in position between the side panels in the finished carton;

e. a rectangular back panel having long and short sides and attached to each of the side panels by the long sides thereof;

f. a bottom panel attached both to the front panel and a short side of the back panel;

g. a top panel attached to the other short side of the back panel; and h. a lock flap attached to the top panel and having locking tabs thereon, the infolding panels each having a notch formed in its upper edge to receive a respective one of the locking tabs therein.

3. A blank for a wristwatch display carton as claimed in claim 2 wherein a triangular flap is attached to each side of the face panel, each triangular flap being adapted to being received between the adjacent side panel and its respective infolding flap to aid in positioning the face panel.

4. A blank for a wristwatch display carton as claimed in claim 3 wherein a pair of front side flaps are formed extending from the sides of the front panel, and an interior bottom flap is attached to each side flap, the front side flaps being foldable to overlie the interior bottom flaps in the finished carton.

5. A blank for a wristwatch display carton as claimed in claim 3 wherein a retaining flap extends from the face panel and an infolding top flap is attached to each of the side panels, the retaining flap being foldable under the top panel and over the infolding top flaps to help position the face panel.

6. A blank for a wristwatch display carton as claimed in claim 5 wherein a positioning wing is attached to each of the infolding panels.

7. A blank for a wristwatch display carton as claimed in claim 2 wherein a pair of tuck flaps are provided extending between each of the side panels and the bottom panel, the pairs of tuck flaps being foldable to lie adjacent to the side panel in the erected carton.

8. A blank for a wristwatch display carton as claimed in claim 7 wherein a retaining flap is attached to each side of the face panel, the retaining flaps being foldable to be received between the folded pairs of tuck flaps and the adjacent side panels.

9. A blank for a wristwatch display carton as claimed in claim 8 wherein a retaining tab extends from each of the side panels, the retaining tabs being foldable to be received between the respective retaining flap and the front panel in the erected carton.

10. A blank for a wristwatch display carton as claimed in claim 8 wherein the retaining flaps are shaped and sized so as to abut the bottom panel and the back panel when the face panel is in position in the erected carton.

11. A blank for a wristwatch display carton as claimed in claim 7 wherein a pair of tuck flaps is provided extending between each of the side panels and the top panel.

12. A blank for a wristwatch display carton as claimed in claim 7 wherein a cover flap is attached to the lock flap.

* * * * *